US006368408B1

(12) United States Patent
Schuler

(10) Patent No.: US 6,368,408 B1
(45) Date of Patent: Apr. 9, 2002

(54) DEVICE FOR COATING THE FLANKS OF SPACER FRAMES FOR INSULATING GLASS PANES

(75) Inventor: Peter Schuler, Tiefenbronn (DE)

(73) Assignee: Lenhardt Maschinenbau GmbH (DE)

( * ) Notice: Subject to any disclaimer, the term of this patent is extended or adjusted under 35 U.S.C. 154(b) by 0 days.

(21) Appl. No.: 09/426,617

(22) Filed: Oct. 26, 1999

(30) Foreign Application Priority Data

Feb. 26, 1999 (DE) ..... 299 03 448 U

(51) Int. Cl.[7] ..... B05C 5/02

(52) U.S. Cl. ..... 118/316; 118/324; 118/426; 118/428; 118/503

(58) Field of Search ..... 118/424, 426, 118/428, 503, 316, 324, DIG. 9; 156/109, 555, 578; 427/208

(56) References Cited

U.S. PATENT DOCUMENTS

| | | | | |
|---|---|---|---|---|
| 4,025,993 A | * | 5/1977 | Kuroda | 118/420 |
| 4,546,723 A | * | 10/1985 | Leopold et al. | 118/669 |
| 4,617,073 A | * | 10/1986 | Scott | 156/109 |
| 5,240,545 A | * | 8/1993 | Washizaki et al. | 156/555 |
| 5,295,292 A | * | 3/1994 | Leopold | 156/109 |
| 6,245,145 B1 | * | 6/2001 | Lisec | 118/300 |

FOREIGN PATENT DOCUMENTS

| | | |
|---|---|---|
| DE | 29719564 | 1/1997 |
| EP | 0902150 | 8/1998 |

* cited by examiner

*Primary Examiner*—Laura Edwards
(74) *Attorney, Agent, or Firm*—Orum & Roth

(57) ABSTRACT

Device for coating sidewalls or flanks (6) of a spacer frame (7) for insulating glass panes with an adhesive or sealant, in which the spacer frame consists of a plurality of members (8); the device having a conveyor (1) that defines a conveying direction (2) and on which one of said members (8) of the spacer frame (7) is laid down to be conveyed by said conveyor (1); a support (9) provided above the conveyor (1) for supporting those members (8) of the spacer frame (7) that project upwardly from the conveyor (1); opposing nozzles (4) provided on both sides of the conveyor (1) for applying said adhesive or sealant to the flanks (6) of the respective member (8) of the spacer frame (7) laid down on the conveyor (1); and guide rolls (10, 10*a*, 11, 11*a*) located above the conveyor (1) that guide the respective member (8) of the spacer frame (7) laid down on the conveyor (1) by bearing against both flanks (6) of this member (8) with their outer circumferential surface (20), or at least with an edge of said circumferential surface (20); at least a subset of the guide rolls (10, 10*a*, 11, 11*a*) is so designed and/or arranged that during the conveying process as they roll along the flanks (6), they exert on the flanks (6) with their outer circumferential surface (20) or with the edge thereof an additional force that is directed towards the conveyor (1).

18 Claims, 5 Drawing Sheets

DEVICE FOR COATING THE FLANKS OF SPACER FRAMES FOR INSULATING GLASS PANES

Figure 1:
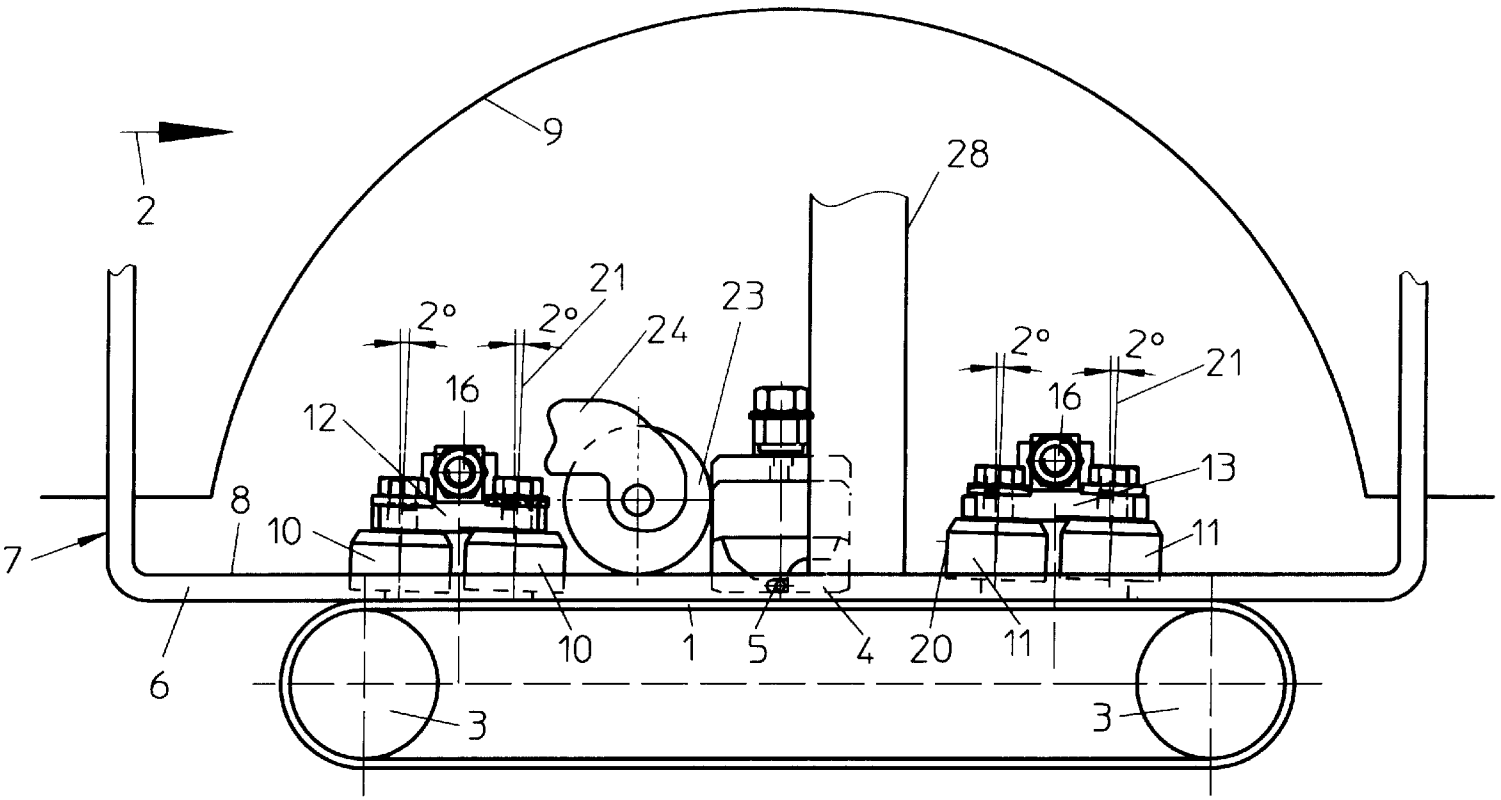

The invention starts out from a device disclosed in DE 297 19 564 U1.

The prior art device described in DE 297 19 564 U1 is equipped with guide rolls that guide the lower member of a spacer frame between two opposing nozzles by bearing against its two flanks or sidewalls with their running surfaces (outer circumferential surfaces), while at the same time the nozzles apply an adhesive or sealant on the same two flanks. Relative to the specified conveying direction, these guide rolls are located ahead of the nozzles. In order to prevent slippage between the conveyor belt and the spacer frame which could result in uneven coating, the known device is equipped with pressing rolls that can be pivoted into position both ahead of and after the nozzles relative to the conveying direction, and can apply pressure on the upper side of the lower member of the spacer frame, thereby increasing pressure on the conveyor belt on which the lower member lies.

However, these pressing rolls are not suitable for guiding the spacer frame laterally.

Moreover, they have to be pivoted out of the motion plane of the spacer frame when upwardly projecting members of the spacer frame approach the pressing rolls during the coating process. Furthermore, when coating spacer frames with crosspieces, the pressing rolls have to be temporarily pivoted out of the motion plane of the spacer frame to allow the crosspieces to pass the pressing rolls. This could compromise the frictional connection between spacer frame and conveyor belt for spacer frames with closely spaced crosspieces.

In order to overcome these disadvantages, DE 297 19 564 U1 discloses an additional device for coating the flanks of spacer frames for insulating glass panes with adhesive or sealant. This additional device is comprised of a conveyor with nozzles on both sides of the conveyor for applying adhesive or sealant on the flanks of the spacer frame, a support above the conveyor for supporting upwardly projecting members of the spacer frame, and pressing rolls that can apply pressure on the upper side of the lower member of the spacer frame, thereby increasing pressure on the conveyor belt on which the lower member lies, and that can be pivoted away again. In this additional device the pressing rolls differ in that they do not bear on the upper side as first described, but only on the lateral edges of the upper side of the lower member of the spacer frame. This proposal makes use of the fact that the crosspieces are generally narrower than the spacer frame itself, so that pressing rolls that only barely reach into the spacer frame by contacting only the lateral edges of the upper side of the lower member of the spacer frame can pass the narrower crosspieces without having to be lifted off first In a first exemplary embodiment, DE 297 19 564 U1 proposes stepped pressing rolls whose smaller diameter portion contacts the outer edge of the upper side of the spacer frame member and whose ring area, oriented perpendicular to the axis of rotation, contacts the flanks of the hollow cross-section of the spacer frame member. This exemplary embodiment is advantageous in that the pressing rolls, although only bearing down on an area on the upper edge of the frame member, cannot slide off the frame member, since the ring area of the pressing roll adjacent to the flank of the frame member is constrained by the flank. However, It is disadvantageous in that the width of the spacer frame has to be precisely known before the pressing rolls can be precisely set down on the lower member of the spacer frame. Moreover, the ring area of the pressing rolls rubs against the spacer frame which-causes some wear and tear.

In a second exemplary embodiment of DE 297 19 564 U1 pressing rolls with horizontal axes of rotation and conical running surfaces are disclosed. These pressing rolls can be pivoted down and positioned on the edge of the upper side of the lower spacer frame member. Here also the width of the spacer frame has to be precisely known in order to correctly position the rolls for them, on the one hand, to reach into the spacer frame sufficiently and to contact the upper edge of the frame member reliably, but on the other hand, to reach not too far into the spacer frame, so that they do not collide with the crosspieces. Furthermore, in case the hollow sections of the frame have sharp edges, the running surfaces of the pressing rolls may wear down resulting in unsteady running of the spacer frame.

It must be ensured that the pressing rolls in both exemplary embodiments pass both the thickest crosspieces as well as slightly eccentric ones without colliding with them.

The object of the current invention is a device of the type described in the beginning, where slippage-free transport of spacer frames, even spacer frames with crosspieces, during coating is achieved by simpler means.

This object is solved by a device for coating sidewalls or flanks of a spacer frame for insulating glass panes with an adhesive or sealant, in which the spacer frame consists of a plurality of members; comprising:

- a conveyor that defines a conveying direction and on which one of said members of the spacer frame is laid down to be conveyed by said conveyor;
- a support provided above the conveyor for supporting those members of the spacer frame that project upwardly from the conveyor;
- opposing nozzles provided on both sides of the conveyor for applying said adhesive or sealant to the flanks of the respective member of the spacer frame laid down on the conveyor;
- and guide rolls located above the conveyor that guide the respective member of the spacer frame laid down on the conveyor by bearing against both flanks of this member with their outer circumferential surface, or at least with an edge of said circumferential surface;
- wherein at least a subset of the guide rolls is so designed and/or arranged that during the conveying process as they roll along the flanks, they exert on the flanks with their outer circumferential surface or with the edge thereof an additional force that is directed towards the conveyor.

Advantageous further embodiments of the invention are the subject of the dependent claims.

According to the invention the guide rolls that contact the flanks of the lower member of the spacer frame with their running surface (outer circumferential surface), or at least with their edge, are designed and/or arranged so that they exert on the flanks of this member of the spacer frame a force that is directed against the conveyor during the conveying and coating process. This may be achieved by applying a force on the guide rolls, after clamping the lower member of the spacer frame between them, and directing this force against the conveyor, whereby the force may not exceed the static frictional force between the guide rolls and the flanks of the spacer frame. In this manner the guide rolls, only by contacting the flanks of the spacer frame, can also affect the frictional connection between spacer frame and conveyor in order to eliminate slippage between the conveyor and the spacer frame.

The conveyor is customarily configured as an endless, driven conveyor belt. The conveyor belt is dragged over an essentially horizontal support area that supports and guides the belt from below. Also conceivable is a conveyor belt in the form of a horizontal row of synchronized driven rollers with essentially horizontal axes of rotation.

Especially advantageous and therefore preferred is the use of guide rolls whose axis of rotation is inclined against the conveying direction of the conveyor. Because of the inclination the guide rolls exert a force that is directed against the conveyor while and by rolling on the flanks of the lower member of the spacer frame. This force increases as the axis of rotation of the guide rolls is tilted from the well-known vertical to a tilted position that is inclined against the conveying direction. Since with increasing inclination friction between the guide rolls and the flanks of the spacer frame member increases also, a small inclination is preferred. It follows that the angle between the axis of rotation of the guide rolls and the conveying direction is preferably at least 80 degrees and not more than 89 degrees. Preferably the angle between the axis of rotation and the conveying direction is at least 85 degrees, or better 86 to 88 degrees.

In the invention on hand cylindrical guide rolls are preferred. Their axis rotation is best inclined exclusively in the conveying direction, because the outer circumferential surface of the guide roll then contacts the flanks not only with its edge but also along a straight line on its outer circumferential surface. Therefore static friction between the guide rolls and the flanks of the spacer frame is greater and a more favorable force transfer on the flanks is achieved.

Furthermore, it is possible to configure conical guide rolls. In this case the angle between the cone axis and the flanks of the spacer frame is best chosen as one half of the out-to-out cone angle, so that the outer surface of the guide rolls can roll along the flanks of the spacer frame with maximum possible static friction. In this case also, the desired effect is essentially due to the inclination of the axis of rotation against the conveying direction, whereby the conical shape can indeed contribute to the force exerted on the flanks and directed against the conveyor.

The invention has significant advantages:

Basically, pressing rolls are not required. Only preferably but not at all by necessity, an additional holding down roll ahead of the nozzles relative to the conveying direction is provided in one exemplary embodiment of the invention. This holding down roll may not only be pivoted down on the lateral edge of the upper side of the lower edge of the spacer frame member (as taught in DE 297 19 564 U1) but may be pivoted down centrally on the upper side, as already known earlier. It is to increase the frictional connection between the spacer frame and the conveyor in the beginning phase, until the guide rolls on the flanks have developed their maximum effectiveness. The guide rolls can take on this task also, (that is, strengthening the frictional connection in the beginning phase), if they are deployed so that they clamp the frame member and pull it down toward the conveyor. A device configured in this manner does not require the pressing action of any pressing roll on the upper side of the spacer frame member Since the guide rolls bear solely on the flanks of the spacer frame, it is not necessary to know the width of the respective spacer frame beforehand. Rather, it is sufficient to engage the rolls against the flanks. Preferably they are spring-loaded against the flanks, especially by means of pneumatic piston/cylinder units.

As long as the trailing, upwardly projecting frame member is uncoated, the guide rolls may simply roll past the trailing end of the spacer frame without lifting off. This is the case for three of the four members of a rectangular spacer frame.

Since the guide rolls do not involve the upper side of the lower member of the spacer frame, spacer frames with crosspieces that are as wide, or almost as wide as the spacer frame itself can be processed with the device according to the invention.

The guide rolls contact the flanks not only in a point, but along a line on their outer circumferential surface, which results in less wear and tear due to lower pressure. The wear and tear of the guide rolls is therefore relatively minor.

Whereas in known devices guide rolls that bear exclusively against the flanks of the spacer frame are arranged solely ahead of the nozzles relative to the conveying direction, guide rolls according to the invention are arranged preferably both ahead of and after the nozzles. Whereas ahead of the nozzles the entire height of the flank is available for contact with the guide rolls, this is not the case after the nozzles. The spacing of the guide rolls after the nozzles is somewhat greater than that ahead of the nozzles and the contact area is above the nozzle openings, so that contact between guide rolls and adhesive or sealant is avoided. It has been shown that the area above the coating of adhesive or sealant is sufficient for slippage-free conveying, when the axis of the guide rolls is inclined against the conveying direction, as required. The vertical position of the guide rolls above the conveyor is preferably adjustable in order to be able to optimize the effective position of the guide rolls.

Just in case the guide rolls accidentally come in contact with the adhesive or sealant, their running surface is preferably wrapped with a fabric that repels the adhesive or sealant. Particularly effective on the running surface has been a ceramic coating whose pores are filled with a material that repels the adhesive or sealant. Suitable fillers are, e.g., a silicone or polytetrafluoroethylene, where a silicone is preferred. An added benefit of the ceramic matrix of the running surface coating is its superior wear resistance.

Figure 2:
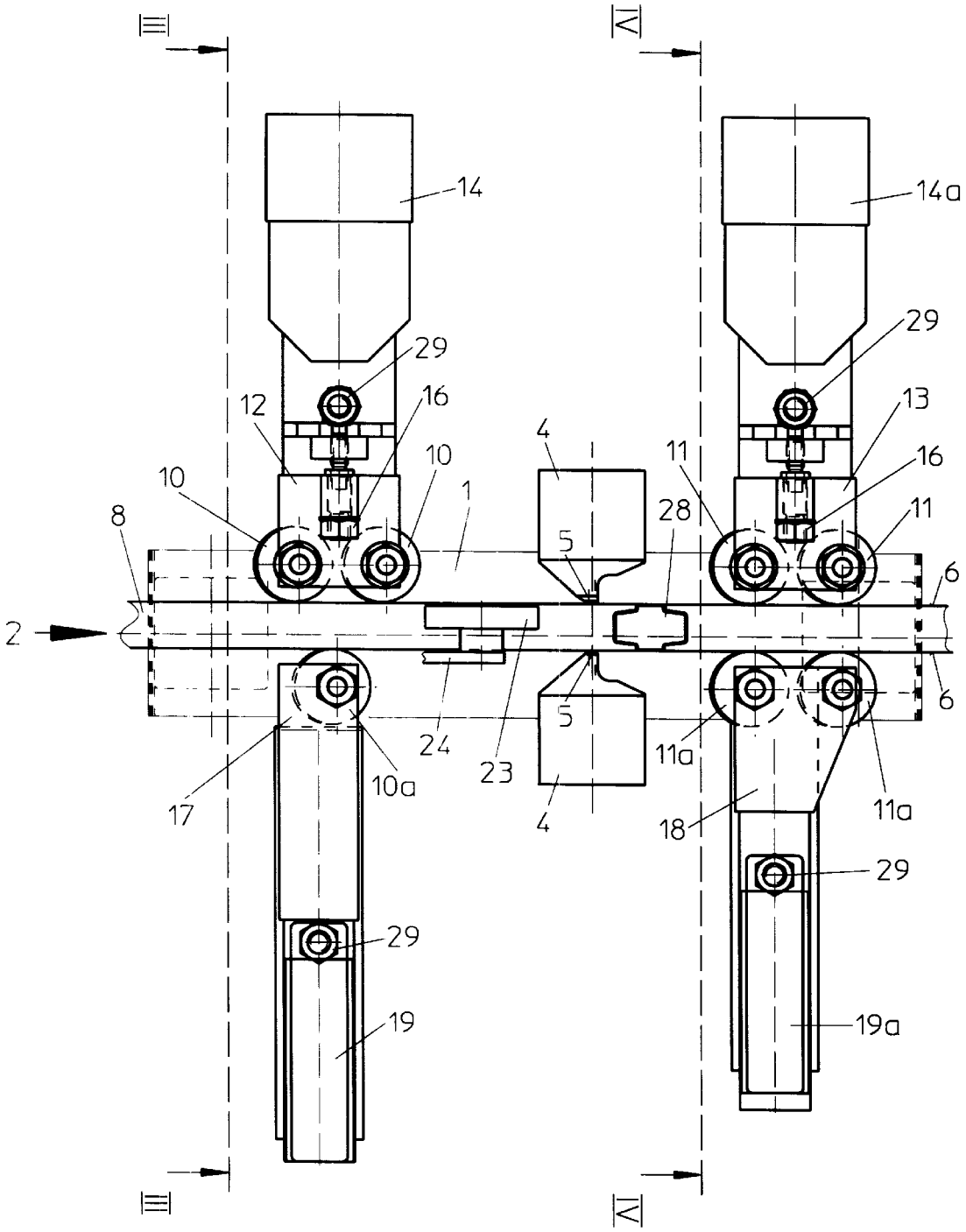
Figure 3:
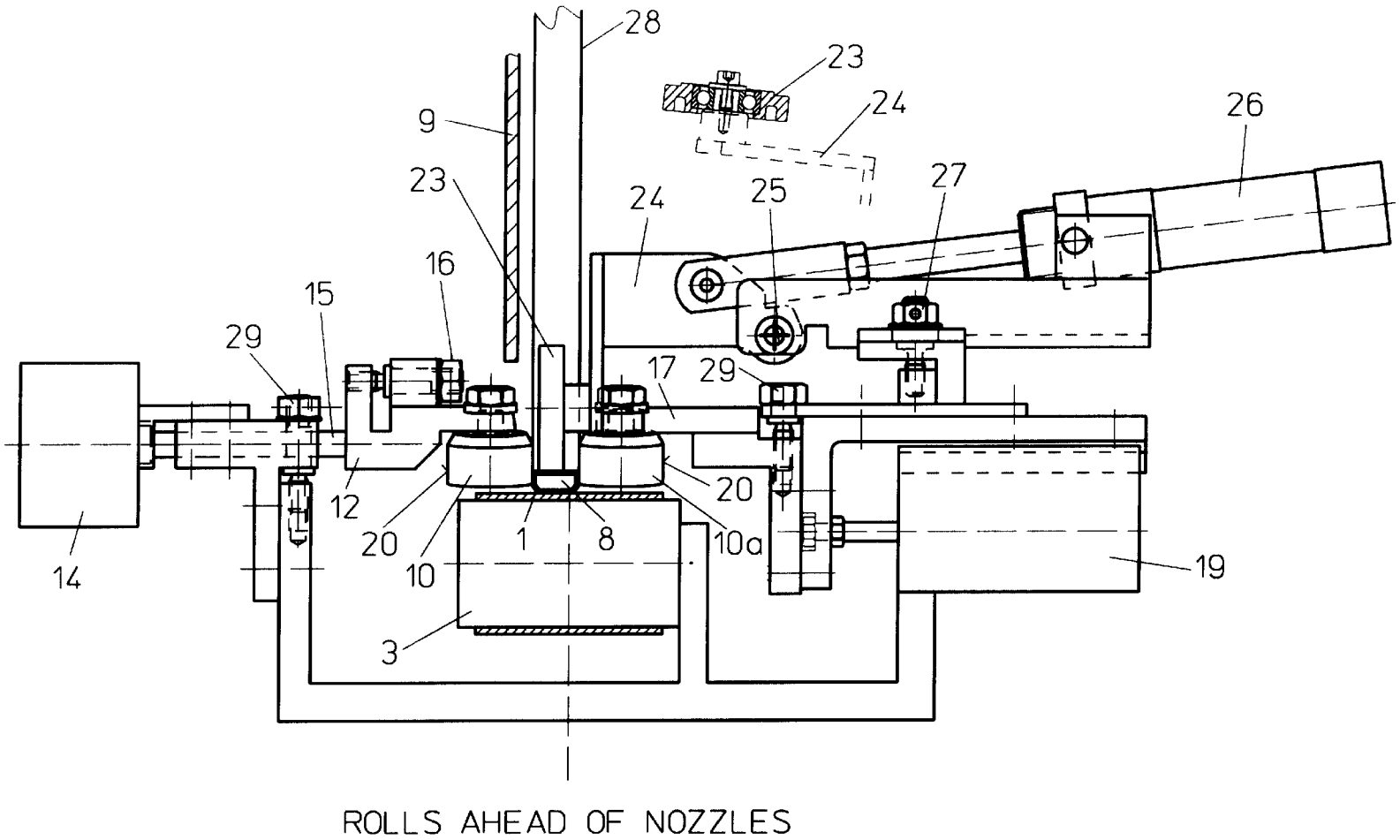
Figure 4:
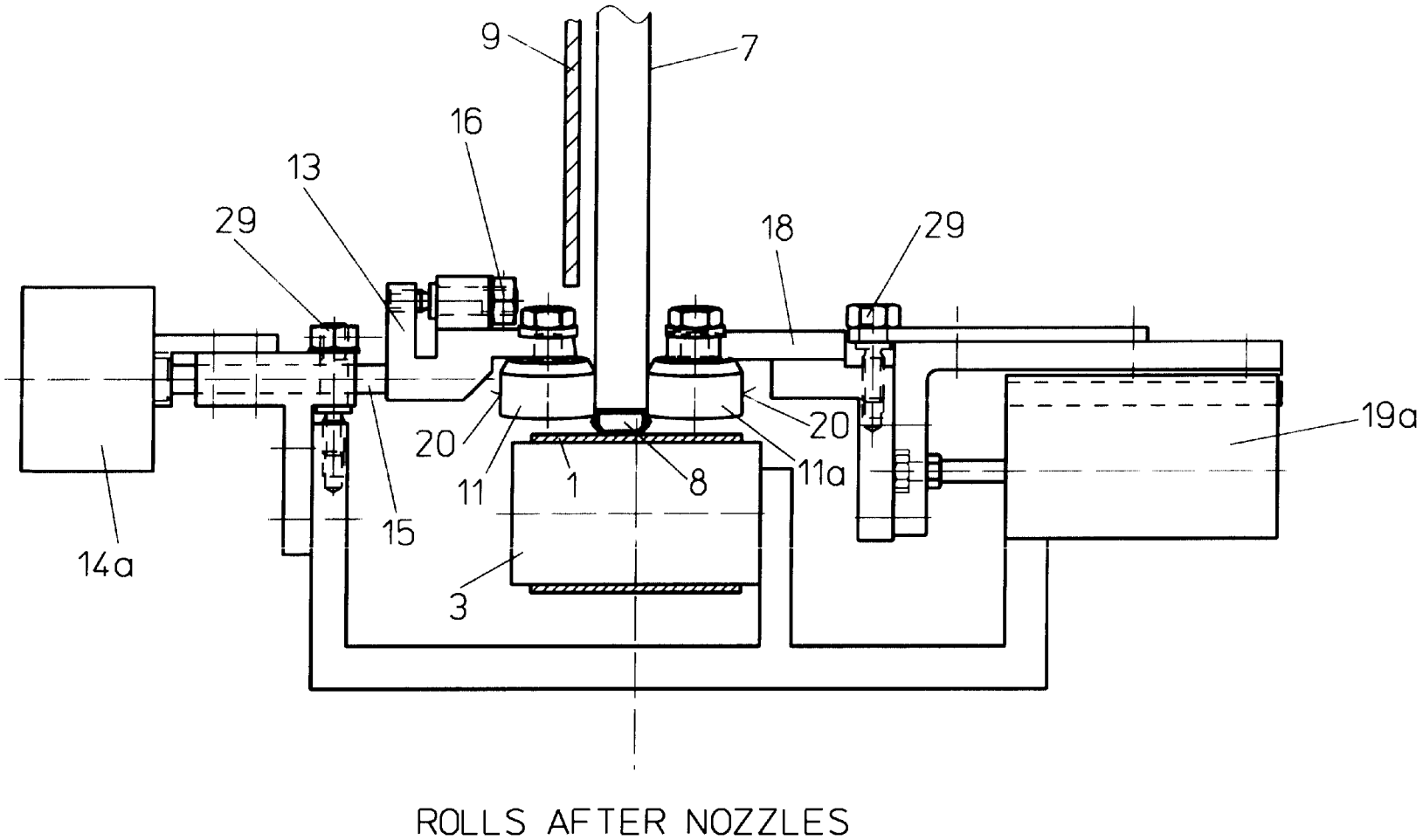
Figure 5:
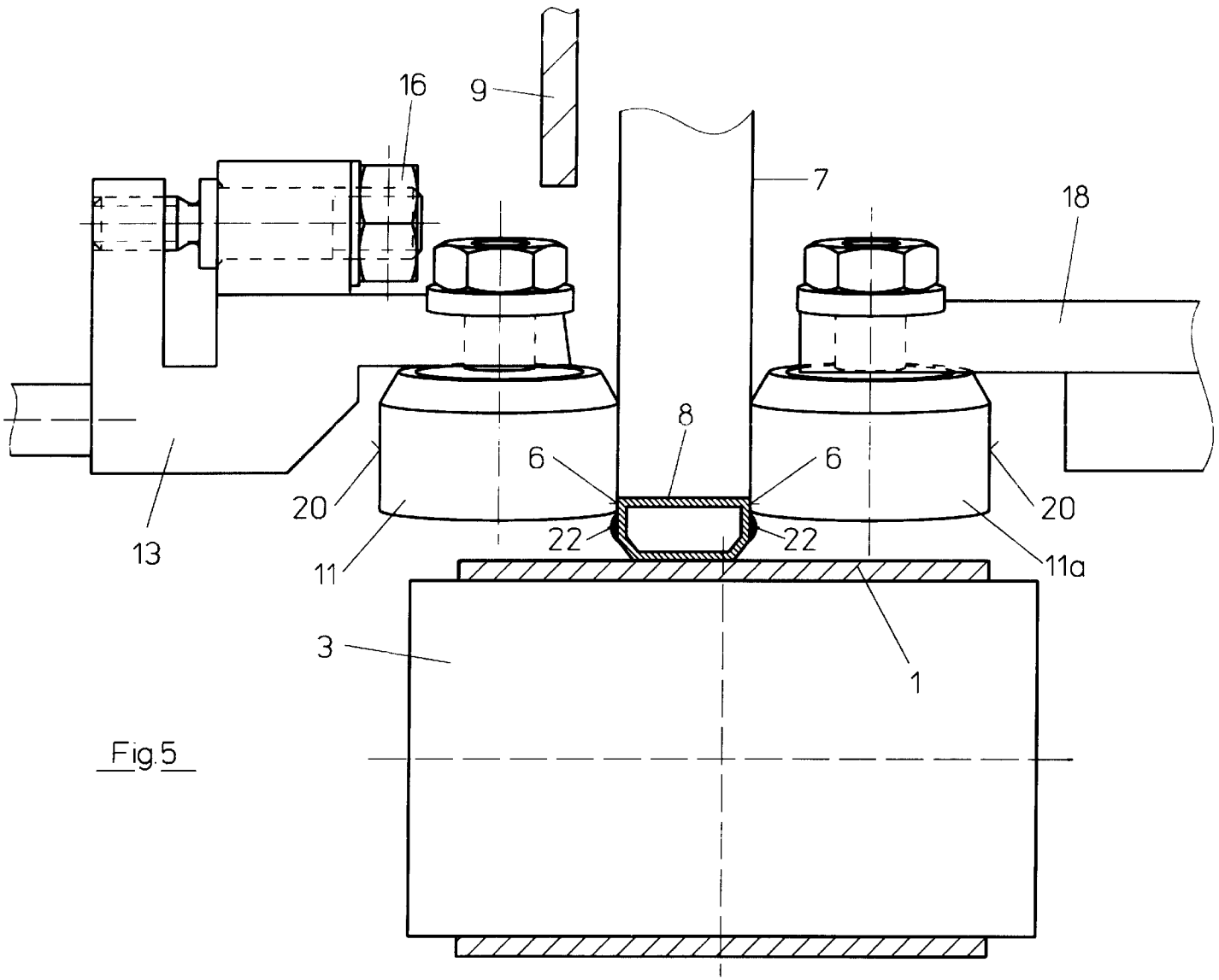

FIG. 1 shows a central section from a front view of a device according to the invention, where parts in the view located in front of the conveyor are omitted for clarity, FIG. 2 shows in plan view the conveyor, the nozzles and the guide rolls of the device in FIG. 1, FIG. 3 shows a vertical section through the device according to Section III—III in FIG. 2, FIG. 4 shows a vertical section through the device according to Section IV—IV in FIG. 2, and FIG. 5 shows an enlarged section of FIG. 4

Identical or corresponding parts in the two exemplary embodiments are designated with the same reference numbers.

The exemplary embodiment illustrated in FIGS. 1 through 5 shows a conveyor 1 with horizontal conveying direction 2. The conveyor 1 is configured as an endless conveyor belt that wraps around two rollers 3, one of which is driven. The carrying run of the conveyor 1 is supported by a horizontal ledge or a horizontal bar omitted for clarity.

Two nozzles 4 are provided, one on each side of the conveyor 1, with their nozzle openings 5 facing each other The nozzles 4 are used for applying an adhesive or sealant, especially polyisobutylene, on the two flanks 6 of a spacer frame for insulating glass panes. Specifically, the coating is applied in a continuous operation on each lower member 8 of the spacer frame lying on the conveyor 1. After a frame member is coated, the spacer frame is turned by 90 degrees and then the next member, now lower member, is coated, and so on, until all members of the spacer frame are coated. The spacer frames are supported laterally, in the illustrated example by a support wall 9 that is provided with a coating that repels the adhesive or sealant. The support wall 9 is arranged behind the conveyor 1, parallel to it and inclined at an angle of, say, 6 degrees from the vertical, so that the spacer frame can lean against the support wall 9 and does not topple over.

Ahead of the nozzles 4 relative to the conveying direction 2, a first set of guide rolls 10 and 10*a* is provided. After the nozzles 4 relative to the conveying direction 2, a second set of guide rolls 11 and 11*a* is provided. The guide rolls 10, 10*a*, 11 and 11*a* are arranged on both sides of the conveyor 1, as illustrated in FIG. 2. In the front view of FIG. 1, only guide rolls 10 and 11 located behind the conveyor are shown.

The guide rolls 10 and 11 located behind the conveyor 1 and under the sporting wall, are supported freewheeling in pairs by a supporting bracket 12 and 13 respectively, that can be advanced or retracted by a pneumatic short-stroke cylinder 14 and 14*a*, respectively. The position of the guide rolls 10 and 11 can be fine-adjusted by means of an adjusting screw 16 relative to the cylinder rod 15 of the short-stroke cylinder 14, 14*a*. This allows precise adjustment of the forward position of the guide rolls 10 and 11 located under the support wall 9 with respect to the gap between the two nozzles 4, so that the spacer frame 7 is guided precisely into the gap between the nozzles 4 by the guide rolls 10, 10*a*, 11, 11*a*.

Ahead of the nozzles 4 relative to conveying direction, there is a guide roll 10*a*.

It is located in front of the conveyor, centered on the guide rolls 10 and supported freewheeling on a supporting bracket 17. After the nozzles 4 relative to the conveying direction, there are two identical guide rolls 11*a*. They are located in front of the conveyor, centered on the two guide rolls 11 and supported freewheeling on an supporting bracket 18. Each supporting brackets 17 and 18 can be advanced and retracted by a pneumatic cylinder 19 and 19*a*, respectively. The stroke of pneumatic cylinders 19, 19*a* is greater than that of the short-stroke cylinders 14 and 14*a*.

The guide rolls 10, 10*a*, 11 and 11*a* are of the same design. They have a cylindrical running or outer circumferential surface 20 and an axes of rotation 21 that is inclined by 2 degrees from a plane perpendicular to the conveyor 1 against the conveying direction. In other words: the angle between the conveying direction 2 and the axes of rotation 21 is 88 degrees.

Whereas the guide rolls 10, 10*a* ahead of the nozzles are spaced very closely above the conveyor belt 1, so that they bear on the flanks 6 of the lower members 8 of the spacer frame over their entire height (see FIG. 3), the guide rolls 11, 11*a* after the nozzles are spaced at a greater distance above the conveyor belt 1 so that they bear on the flanks 6 above the bead 22 of adhesive or sealant deposited on the flanks 6 by the nozzles, as illustrated in FIGS. 4 and 5.

Ahead of the nozzles 4 a holding-down roll 23 is provided; it is supported freewheeling on a support bracket 24 that can be pivoted around an axis 25 parallel to the conveying direction 2. An additional pneumatic cylinder 26 is used for pivoting the holding-down roll 23 from a parked position (shown in FIG. 3 in section view with dashed holder) into an operating position in which it presses down on the upper side of the lower member 8 of the spacer frame. In order to accommodate spacer frame cross-sections of various heights, the holding own roll 23, complete with actuating pneumatic cylinder 26, can be adjusted with an adjusting screw 27. The height of the guide rolls 10, 10*a*, 11, 11*a* can be adjusted with an adjusting screw 29 correspondingly.

The device operates as follows:

Standing and leaning against the support wall 9, the spacer frame 7, divided by a crosspiece 28, is transported on conveyor 1 in conveying direction 2. The guide rolls 10, 11, located behind the conveyor and under the support wall 9, are in their forward position and slightly projecting with their outer surface 20 from under the support wall 9. As soon as the leading, lower corner of the spacer frame 7 is between the guide rolls 10 10*a* located ahead of the nozzles 4, the pneumatic cylinder 19 is actuated, thereby pressing the guide roll 10*a* located ahead of the nozzles 4 against the flank 6 of the lower member 8 of the spacer frame, so that the lower member 8 is clamped between the guide rolls 10, 10*a* and guided by them into the gap between the nozzles 4.

As soon as the leading, lower corner of the spacer frame 7 has passed the holding-down roll 23, the holding-down roll 23 pivots down into the operating position and presses the lower member 8 against the conveyor 1. As soon as the leading lower corner of the spacer frame 7 is between the nozzle openings 5, the nozzles begin to apply the adhesive or sealant onto both flanks 6 of the lower member 8. As soon as the leading, lower corner of the spacer frame 7 is between the guide rolls 11, 11*a* located after the nozzles 4, the pneumatic cylinder 19*a* is actuated, thereby pressing the guide rolls 11*a* against the flank 6 of the spacer frame, so that the spacer frame is clamped above the adhesive or sealant bead 22 and between the guide rolls 11 and 11*a*.

The guide rolls 10, 10*a*, 11 and 11*a* remain in the described position, until the trailing, lower corner of the spacer frame 7 arrives between the nozzle openings 5. Then the guide rolls 10*a* and 11*a* located in front of the conveyor 1 are retracted by the two pneumatic cylinders 19 and 19*a*, the spacer frame 7 is turned by 90 degrees against the conveying direction 2 and the new frame member, now in the lower position, is coated in the described manner. When coating the forth (and last) frame member, the guide rolls 10 located behind the conveyor 1 are retracted also as soon as the trailing, lower corner of the spacer frame reaches the guide rolls 10, so that the guide rolls 10 do not roll over bead 22 of adhesive or sealant of the trailing, upwardly projecting frame member.

Every time a crosspiece 28 approaches, the holding-down roll 23 is pivoted out of the spacer frame 7 for a short period of time. When crosspieces 28 follow in rapid succession, the holding own roll 23 may remain in its upper, parked position, since the guide rolls 10, 10*a*, 11 and 11*a*, due to the inclined position of their axes of rotation 21, already exert a force on the flanks 6 against the conveyor belt 1, which prevents slippage between the spacer frame 7 and the conveyor belt 1. The holding-down roll 23 is also pivoted into the parked position when the trailing, upwardly projecting member of the spacer frame approaches.

LIST OF REFERENCE NUMERALS:

1 conveyor
2 conveying direction
3 rolls
4 nozzles
5 nozzle openings

6 the flanks or sidewalls of 7
7 spacer frame
8 lower side of 7
9 support wall
10, 10*a* "first" guide rolls (a=in front)
11, 11*a* "second" guide rolls (a=in front)
12 supporting bracket of 10
13 supporting bracket of 11
14, 14*a* pneumatic short-stroke cylinder
15 cylinder rod
16 adjusting screw
17 supporting bracket of 10*a*
18 supporting bracket of 11*a*
19, 19*a* pneumatic cylinder
20 outer circumferential surface
21 axis of rotation
22 bead
23 holding-down roll
24 supporting bracket of 23
25 axis of 24
26 pneumatic cylinder for 23
27 adjusting screw
28 crosspiece
29 adjusting screw

What is claimed is:

1. Device for coating sidewalls or flanks (6) of a spacer frame (7) having a plurality of members (8), comprising:

a conveyor (1) that defines a conveying direction (2) and on which one of said members (8) of the spacer frame (7) is laid down to be conveyed by said conveyor (1);

a support (9) provided above the conveyor (1) for supporting those members (8) of the spacer frame (7) that project upwardly from the conveyor (1);

opposing nozzles (4) provided on both sides of the conveyor (1) for applying said adhesive or sealant to the flanks (6) of the respective member (8) of the spacer frame (7) laid down on the conveyor (1); and guide rolls (10, 10*a*, 11, 11*a*) located above the conveyor (1) that guide the respective member (8) of the spacer frame (7) laid down on the conveyor (1) by bearing against both flanks (6) of this member (8) with their outer circumferential surface (20), or at least with an edge of said circumferential surface (20);

and further comprising at least a subset of the guide rolls (10, 10*a*, 11, 11*a*) designed and/or arranged that during conveyance, they roll along the flanks (6), they exert on the flanks (6) with their outer circumferential surface (20) or with the edge thereof an additional force that is directed towards the conveyor (1).

2. Device for coating sidewalls or flanks (6) of a spacer frame (7) having a plurality of members (8), glass panes with an adhesive or sealant, comprising:

a conveyor (1) that defines a conveying direction (2) and on which one of said members (8) of the spacer frame (7) is laid down to be conveyed by said conveyor (1);

a support (9) provided above the conveyor (1) for supporting those members (8) of the spacer frame (7) that project upwardly from the conveyor (1);

opposing nozzles (4) provided on both sides of the conveyor (1) for applying said adhesive or sealant to the flanks (6) of the respective member (8) of the spacer frame (7) laid down on the conveyor (1);

and guide rolls (10, 10*a*, 11, 11*a*) located above the conveyor (1) that guide the respective member (8) of the spacer frame (7) laid down on the conveyor (1) by bearing against both flanks (6) of this member (8) with their outer circumferential surface (20), or at least with an edge of said circumferential surface (20);

and further comprising at least a subset of the guide rolls (10, 10*a*, 11, 11*a*) designed and/or arranged that during conveyance, they roll along the flanks (6), they exert on the flanks (6) with their outer circumferential surface (20) or with the edge thereof an additional force that is directed towards the conveyor (1); and an axis of rotation (21) of the guide rolls (10, 10*a*, 11, 11*a*) is inclined against the conveying direction (2) of the conveyor (1).

3. Device according to claim 2, wherein the angle between the axis of rotation (21) of the guide rolls (10, 10*a*, 11, 11*a*) and the conveying direction (2) is at least 80 degrees.

4. Device according to claim 2, wherein the angle between the axis of rotation (21) of the guide rolls (10, 10*a*, 11, 11*a*) and the conveying direction (2) is at least 85 degrees.

5. Device according to claim 2, wherein the angle between the axis of rotation (21) of the guide rolls (10, 10*a*, 11, 11*a*) and the conveying direction (2) is 86 degrees to 88 degrees.

6. Device according to claim 2, wherein the angle between the axis of rotation (21) of the guide rolls (10, 10*a*, 11, 11*a*) and the conveying direction (2) is not greater than 89 degrees.

7. Device according to claim 2, wherein the axis of rotation (21) of the guide rolls (10, 10*a*, 11, 11*a*) is inclined exclusively against the conveying direction (2) of the conveyor (1).

8. Device according to claim 2, wherein the guide rolls (10, 10*a*, 11, 11*a*) are arranged both ahead of and after the nozzles (4) relative to the conveying direction (2).

9. Device according to claim 2, wherein the guide rolls (10, 10*a*, 11, 11*a*) are spring-loaded against the flanks (6).

10. Device according to claim 2, wherein pneumatic drives (14, 14*a*, 19, 19*a*) are provided enabling the guide rolls (10, 10*a*, 11, 11*a*) to be advanced towards and retracted from the flanks (6) of the spacer frame (7).

11. Device according to claim 2, wherein the guide rolls (10, 10*a*, 11, 11*a*) have a cylindrical outer circumferential surface (20).

12. Device according to claim 2, wherein the outer circumferential surface (20) of the guide rolls (10, 10*a*, 11, 11*a*) is coated with a material that repels the adhesive or sealant.

13. Device according to claim 2, wherein the guide rolls (11, 11*a*) arranged after the nozzle (4) relative to the conveying direction (2), are spaced at a greater distance along the conveyor (1) than the guide rolls (10, 10*a*) arranged ahead of the nozzles (4).

14. Device according to claim 2, wherein the vertical position of the guide rolls (10, 10*a*, 11, 11*a*) above the conveyor (1) is adjustable.

15. Device according to claim 2, wherein ahead of the nozzles (4) relative to the conveying direction (2) a holding-down roll (23) is provided that can be pivoted down on an upper side of a lower member (8) of the spacer frame (7).

16. Device for coating sidewalls or flanks (6) of a spacer frame (7) having a plurality of members (8), glass panes with an adhesive or sealant, comprising:

a conveyor (1) that defines a conveying direction (2) and on which one of said members (8) of the spacer frame (7) is laid down to be conveyed by said conveyor (1);

a support (9) provided above the conveyor (1) for supporting those members (8) of the spacer frame (7) that project upwardly from the conveyor (1);

opposing nozzles (4) provided on both sides of the conveyor (1) for applying said adhesive or sealant to the flanks (6) of the respective member (8) of the spacer frame (7) laid down on the conveyor (1);

and guide rolls (10, 10*a*, 11, 11*a*) located above the conveyor (1) that guide the respective member (8) of the spacer frame (7) laid down on the conveyor (1) by bearing against both flanks (6) of this member (8) with their outer circumferential surface (20), or at least with an edge of said circumferential surface (20);

and further comprising at least a subset of the guide rolls (10, 10*a*, 11, 11*a*) designed and/or arranged that during conveyance, they roll along the flanks (6), they exert on the flanks (6) with their outer circumferential surface (20) or with the edge thereof an additional force that is directed towards the conveyor (1); and the outer circumferential surface (20) of the guide rolls (10, 10*a*, 11, 11*a*) is provided with a ceramic coating.

17. Device according to claim 16, wherein the ceramic coating is filled with a material that repels the adhesive or sealant.

18. Device according to claim 17, wherein the ceramic coating is filled with a silicone or with a polytetrafluoroethylene.

* * * * *